US008378849B2

(12) United States Patent
Chandra et al.

(10) Patent No.: US 8,378,849 B2
(45) Date of Patent: Feb. 19, 2013

(54) ENABLING DRIVER COMMUNICATION

(75) Inventors: Ankur Chandra, San Jose, CA (US); Anca-Andreea Ivan, New Rochelle, NY (US)

(73) Assignee: International Business Machines Corporation, Armonk, NY (US)

( * ) Notice: Subject to any disclaimer, the term of this patent is extended or adjusted under 35 U.S.C. 154(b) by 440 days.

(21) Appl. No.: 12/510,759

(22) Filed: Jul. 28, 2009

(65) Prior Publication Data

US 2011/0025527 A1 Feb. 3, 2011

(51) Int. Cl.
*G08G 1/09* (2006.01)

(52) U.S. Cl. ..... 340/905; 340/902; 340/995.13

(58) Field of Classification Search ..... 340/905, 340/902, 995.13, 991
See application file for complete search history.

(56) References Cited

U.S. PATENT DOCUMENTS

| | | | | |
|---|---|---|---|---|
| 6,317,682 | B1 * | 11/2001 | Ogura et al. | 701/117 |
| 7,330,103 | B2 * | 2/2008 | Boss et al. | 340/435 |
| 7,522,993 | B2 * | 4/2009 | van Oldenborgh et al. | 701/200 |
| 2002/0072963 | A1 * | 6/2002 | Jonge | 705/13 |
| 2007/0282519 | A1 * | 12/2007 | Emam et al. | 701/117 |
| 2010/0075608 | A1 * | 3/2010 | Ji et al. | 455/66.1 |
| 2010/0201543 | A1 * | 8/2010 | Shorey et al. | 340/902 |

OTHER PUBLICATIONS

Lee et al., CarTorrent: A Bit-Torrent System for Vehicular Ad-hoc Networks, pp. 1-6, Mar. 2010.

* cited by examiner

*Primary Examiner* — Brent Swarthout
(74) *Attorney, Agent, or Firm* — Ryan, Mason & Lewis, LLP

(57) ABSTRACT

Techniques for generating driving information based on one or more driver inputs are provided. The techniques include receiving information about one or more triggering factors from at least one of one or more internal entities and one or more external entities, using the information to generate a message about the one or more triggering factors, and sending the message to one or more additional drivers.

20 Claims, 3 Drawing Sheets

ENABLING DRIVER COMMUNICATION

FIELD OF THE INVENTION

Embodiments of the invention generally relate to information technology, and, more particularly, to driving information.

BACKGROUND OF THE INVENTION

Driving conditions worsen because of traffic and careless drivers. Often, drivers are not aware of the driving conditions, specifically when cars are piling up behind them. Also, accidents can occur many times because of angry drivers who become exceedingly aggressive.

There exists no mechanism, however, that allows drivers to communicate intention, especially as a group. There exist simply well-defined protocols that allow drivers to have limited communication (for example, flashing lights, honking, hand signals, etc.).

SUMMARY OF THE INVENTION

Principles and embodiments of the invention provide techniques for enabling driver communication. An exemplary method (which may be computer-implemented) for generating driving information based on one or more driver inputs, according to one aspect of the invention, can include steps of receiving information about one or more triggering factors from at least one of one or more internal entities and one or more external entities, using the information to generate a message about the one or more triggering factors, and sending the message to one or more additional drivers.

One or more embodiments of the invention or elements thereof can be implemented in the form of a computer product including a tangible computer readable storage medium with computer usable program code for performing the method steps indicated. Furthermore, one or more embodiments of the invention or elements thereof can be implemented in the form of an apparatus including a memory and at least one processor that is coupled to the memory and operative to perform exemplary method steps. Yet further, in another aspect, one or more embodiments of the invention or elements thereof can be implemented in the form of means for carrying out one or more of the method steps described herein; the means can include (i) hardware module(s), (ii) software module(s), or (iii) a combination of hardware and software modules; any of (i)-(iii) implement the specific techniques set forth herein, and the software modules are stored in a tangible computer-readable storage medium (or multiple such media).

These and other objects, features and advantages of the present invention will become apparent from the following detailed description of illustrative embodiments thereof, which is to be read in connection with the accompanying drawings.

DETAILED DESCRIPTION OF EMBODIMENTS

Figure 1:
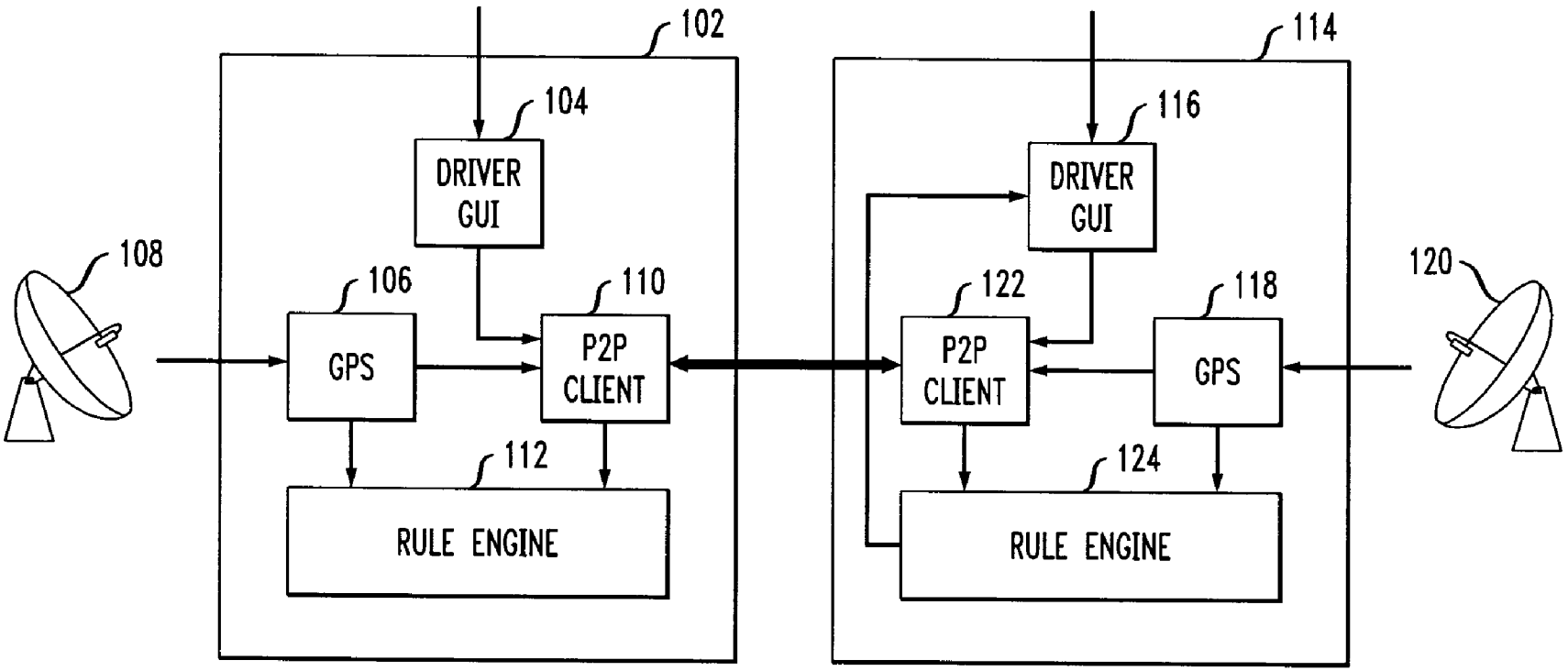
FIG. 1 is a diagram illustrating a system for enabling driver communication, according to an embodiment of the present invention.

Principles of the invention include improving driver awareness by enabling peer-to-peer communication. As described herein, drivers are enabled to communicate information such as, for example, signal changing lane requests, signal intentions (passing, switching lane, etc.), and signal defects (light out, high beam on, lights off, no gas, etc.). In one or more embodiments of the invention, the signals pass the intention and the global positioning system (GPS) location of the sender, and the results are accumulated and passed along to additional drivers. Additionally, a rule engine can be used to extract high-level information for a driver.

One or more embodiments of the invention include mechanisms for voting based on community information. Also, the techniques detailed herein can include informing drivers of possible dangerous situations (for example, cars queued up behind them), informing drivers of possible defects, as well as allowing group communication (for example, voting off a slow driver from the high-speed lane).

By way of example, in one or more embodiments of the invention, cars driving (for example, on the freeway) can send messages both from drivers and sensors. Additionally, a voting algorithm (as well as, for example, a few rules) can be used to decide whether the current driving situation is a possibly dangerous one.

As detailed herein, one or more embodiments of the invention include a system for computing the scores (also referred to as reputations) of all messages (for example, to show the uncertainty of the sender of the message) both online and offline. The online techniques compute the reputation by comparing the initial message sent by the driver with the decision computed by the voting algorithm. If they are similar, the reputation of the message increases. If they differ, the reputation decreases. The offline techniques allow the driver to connect to a website that contains a set of well-defined external events (for example, storm, highway problem, etc.) and compare his or her observations with the actual external events. If the driver observations are similar to the external events, his/her reputation increases. Otherwise, his/her reputation decreases or stays the same.

Additionally, in one or more embodiments of the invention, a voting algorithm can use the sensor data as context data for the message sent by the driver. By way of example, one or more embodiments of the invention could include an implementation of a voting algorithm that uses sensor data as context, such as the illustrative implementation below:

Assume, for example, that the road is icy and one car on the road is skidding. Several drivers notice that, including the driver of the skidding car. The (sometimes implied) question is: "Why is this car skidding?" The car can send its own information: State Information: (Model=Corolla), (Year=2004), (Sliding=true). In addition, other drivers can send out their own answers ("road is icy" or "tires look old"). Together with these answers, drivers send implicit or explicit votes with weights ("road is icy"+"yes"+"90%," "tires look old"+"no"+"100%," "breaks are not working"+"yes"+"10%").

For a given topic (that is, a question that can be voted on; for example, road condition, etc.), there can be several answers and votes.

Votes={Vi, . . . Vn}

Answers={Ai, . . . An}

For a given topic, there will be a set of weights applied to the various answers. Weights={Wi, . . . Wn}

In one or more embodiments of the invention, a voting algorithm will take in the votes, along with the state data and the weightings for the topic to determine what the vote should be. For example, one can have each of the state data normalized (to a value between 0 and 1) and all the weights add up to 1. With such an approach, the result of the vote will be between 0 and 1. This will work, for example, for a Boolean variable (two voting choices for the topic, which can be set to 0 and 1, respectively).

$$\#\text{ of votes of } V0 * \sum_{i=0}^{i=n} Ai * Wi > \#\text{ of votes of } V1 * \sum_{i=0}^{i=n} Ai * Wi.$$

FIG. 1 is a diagram illustrating a system for enabling driver communication, according to an embodiment of the present invention. By way of illustration, FIG. 1 depicts a system component 102 for a first driver that includes a driver graphical user interface (GUI) module 104, a global positioning system (GPS) module 106, a peer-to-peer (P2P) client module 110 and a rule engine module 112. FIG. 1 also depicts a system component 114 for a second driver that includes a driver GUI module 116, a GPS module 118, a P2P client module 122 and a rule engine module 124.

As depicted in FIG. 1, information from a GPS provider (for example, component 108 or 120) can be provided to a GPS module (for example, component 106 or 118), which can provide input to a P2P client module (for example, component 110 or 122) as well as to a rule engine (for example, component 112 or 124). Additionally, input from other sources of information (for example, sensors, Internet, iPod, etc.) can be provided to a driver GUI module (for example, component 104 or 116), which can further provide input to a P2P client module. The P2P client module (for example, component 110 or 122) can provide input to a rule engine module (for example, component 112 or 124). Also, in one or more embodiments of the invention, a rule engine module (for example, component 124) can provide input to a driver GUI module (for example, 116).

Further, as depicted by FIG. 1, a P2P client module (for example, component 110) can interact with one or more other P2P client modules (for example, component 122).

Figure 2:
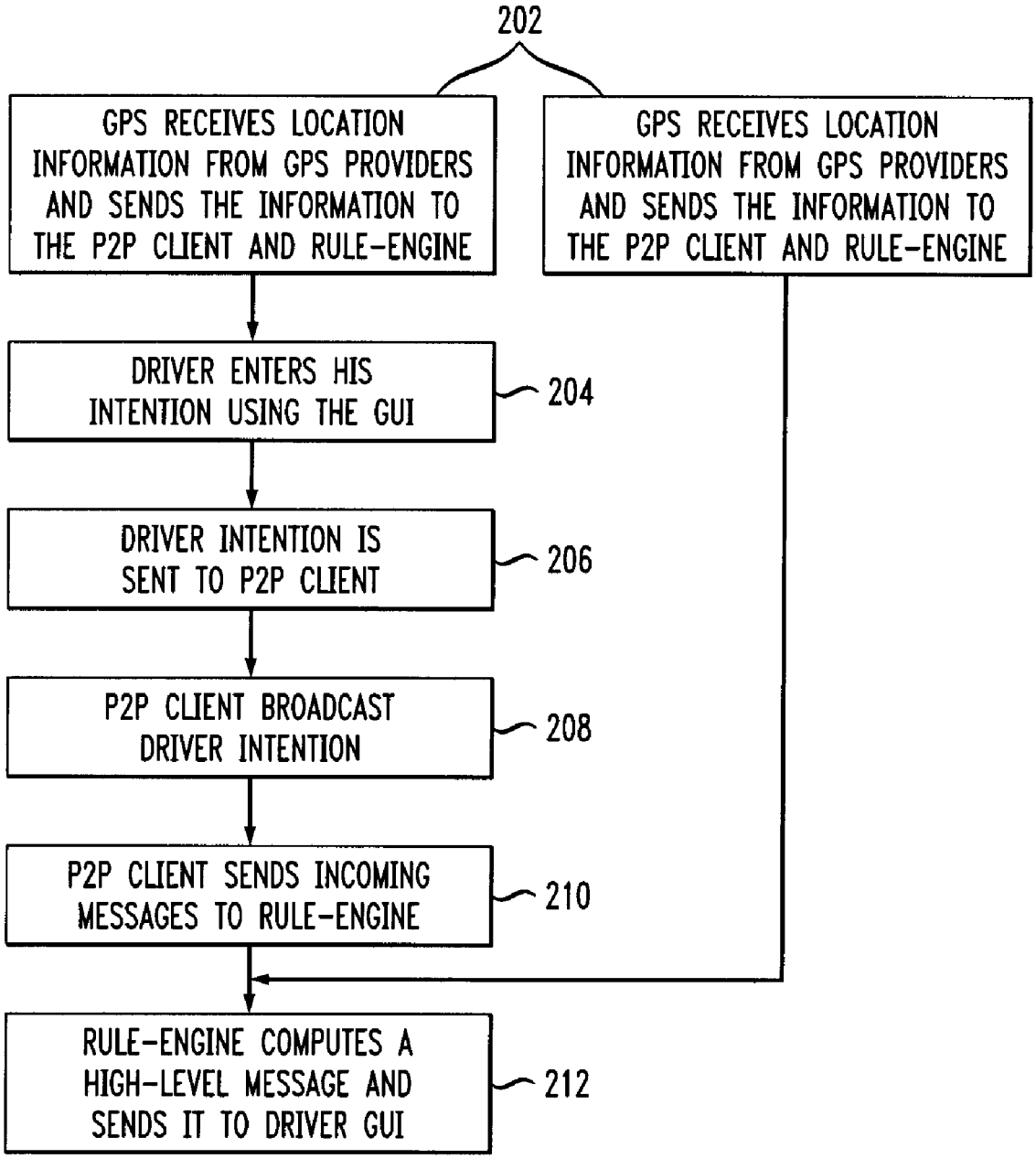
FIG. 2 is a flow diagram illustrating techniques for enabling driver communication.

FIG. 2 is a flow diagram illustrating techniques for enabling driver communication, according to an embodiment of the present invention. Step 202 includes a GPS receiving location information from GPS providers, and sending the information to a P2P client module and a rule engine module. Step 204 includes a driver entering his/her intention via use of a GUI. Step 206 includes sending a driver intention to a P2P client module. Step 208 includes a P2P client module broadcasting the driver intention. Step 210 includes the P2P client module sending incoming messages to a rule engine module. Further, step 212 includes a rule engine module computing a high-level message and sending it to a driver GUI.

Figure 3:
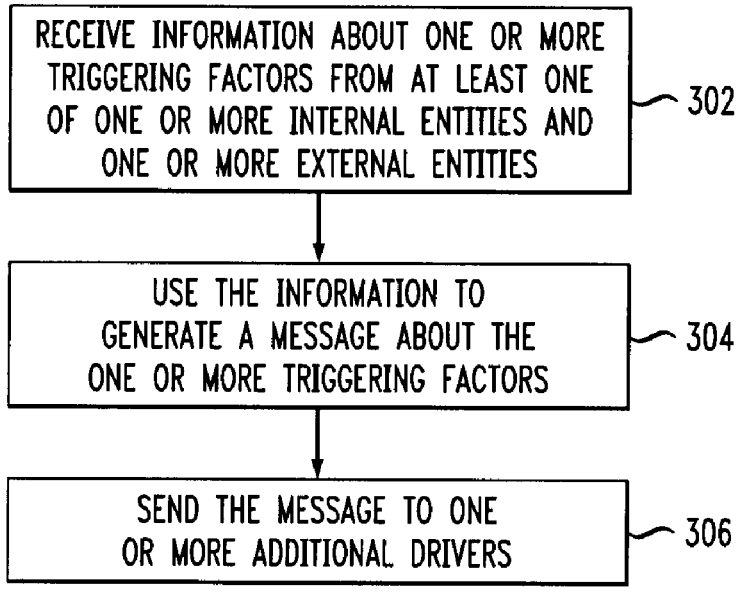
FIG. 3 is a flow diagram illustrating techniques for generating driving information based on one or more driver inputs, according to an embodiment of the invention.

FIG. 3 is a flow diagram illustrating techniques for generating driving information based on one or more driver inputs (for example, with varying degrees of certainty), according to an embodiment of the present invention. Step 302 includes receiving information about one or more triggering factors (for example, a question asked by a driver, a pothole, an accident, proximity of a gas station, etc.) from at least one of one or more internal entities and one or more external entities. Information from internal entities can include, for example, information about a driver from a driver graphical user interface, a car sensor, etc. Also, information from external entities can include, for example, information related to a global positioning system (GPS), information related to a state of a vehicle, etc.

Step 304 includes using the information to generate a message about the one or more triggering factors. Using the information to generate a message about the triggering factors can include computing a score for the message. Computing a score for the message can include computing a score online, which includes comparing the message with a decision computed by a voting algorithm. For example, if the two are similar, the reputation/score of the message increases. If they differ, the reputation/score decreases. Also, computing a score for the message can include computing a score off-line, which includes enabling the driver to connect to a website that contains a set of one or more external events (for example, storm, highway problem, etc.), and comparing the message with the one or more external events. For example, if the driver observations are similar to the external events, his/her reputation increases. Otherwise, his/her reputation decreases or stays the same.

Step 306 includes sending the message to one or more additional drivers. Sending the message to additional drivers can include sending a weighted message based on credibility of each driver that provided input. Additionally, sending the message to additional drivers can include sending the message to additional drivers via a driver graphical user interface of each driver.

The techniques depicted in FIG. 3 can also include comparing the message to one or more driver inputs to dynamically update credibility of each driver. Additionally, one or more embodiments of the invention include enabling a voting mechanism based on driver community information. The voting mechanism can be used to make determinations about one or more driving situations, wherein the voting mechanism uses driver votes, state data and one or more weightings to make a determination about a driving situation.

The techniques depicted in FIG. 3 can also, as described herein, be run on a system, wherein the system includes distinct software modules, each of the distinct software modules being embodied on a tangible computer-readable recordable storage medium. The distinct software modules can include, for example, a driver graphical user interface module, a global positioning system module, a peer-to-peer client module and a rule engine module executing on a hardware processor.

Additionally, the techniques depicted in FIG. 3 can be implemented via a computer program product that can include computer useable program code that is stored in a computer readable storage medium in a data processing system, and wherein the computer useable program code was downloaded over a network from a remote data processing system. Also, in one or more embodiments of the invention, the computer program product can include computer useable program code that is stored in a computer readable storage medium in a server data processing system, and wherein the computer useable program code are downloaded over a network to a remote data processing system for use in a computer readable storage medium with the remote system.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

One or more embodiments of the invention, or elements thereof, can be implemented in the form of an apparatus including a memory and at least one processor that is coupled to the memory and operative to perform exemplary method steps.

Figure 4:
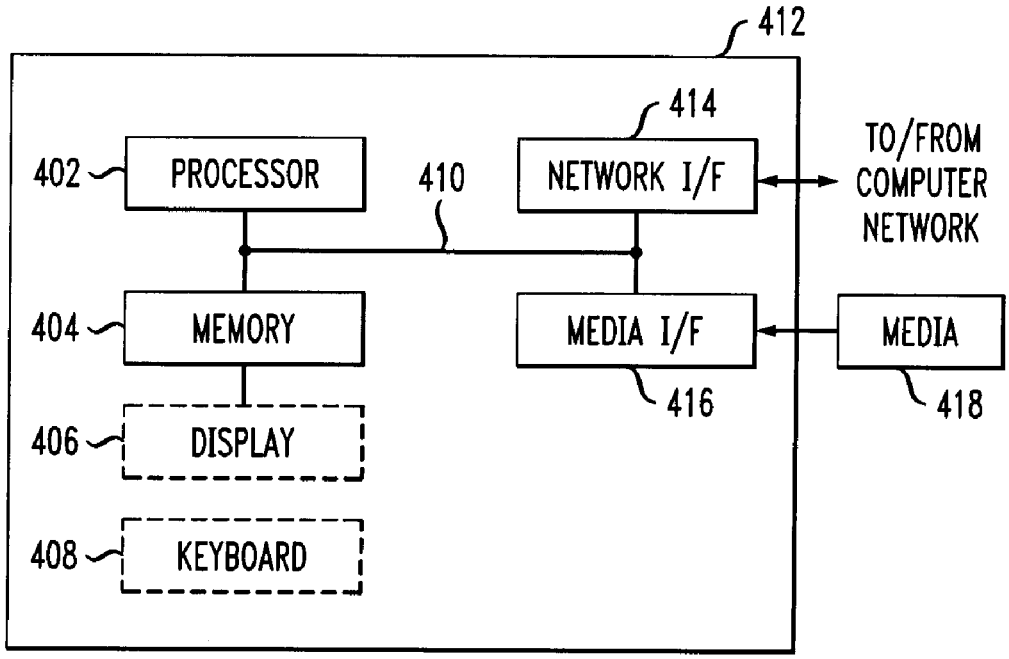
FIG. 4 is a system diagram of an exemplary computer system on which at least one embodiment of the invention can be implemented.

One or more embodiments can make use of software running on a general purpose computer or workstation. With reference to FIG. 4, such an implementation might employ, for example, a processor 402, a memory 404, and an input/output interface formed, for example, by a display 406 and a keyboard 408. The term "processor" as used herein is intended to include any processing device, such as, for example, one that includes a CPU (central processing unit) and/or other forms of processing circuitry. Further, the term "processor" may refer to more than one individual processor. The term "memory" is intended to include memory associated with a processor or CPU, such as, for example, RAM (random access memory), ROM (read only memory), a fixed memory device (for example, hard drive), a removable memory device (for example, diskette), a flash memory and the like. In addition, the phrase "input/output interface" as used herein, is intended to include, for example, one or more mechanisms for inputting data to the processing unit (for example, mouse or a touch-screen), and one or more mechanisms for providing results associated with the processing unit (for example, printer). The processor 402, memory 404, and input/output interface such as display 406 and keyboard 408 can be interconnected, for example, via bus 410 as part of a data processing unit 412. Suitable interconnections, for example via bus 410, can also be provided to a network interface 414, such as a network card, which can be provided to interface with a computer network, and to a media interface 416, such as a diskette or CD-ROM drive, which can be provided to interface with media 418.

Accordingly, computer software including instructions or code for performing the methodologies of the invention, as described herein, may be stored in one or more of the associated memory devices (for example, ROM, fixed or removable memory) and, when ready to be utilized, loaded in part or in whole (for example, into RAM) and implemented by a CPU. Such software could include, but is not limited to, firmware, resident software, microcode, and the like.

A data processing system suitable for storing and/or executing program code will include at least one processor 402 coupled directly or indirectly to memory elements 404 through a system bus 410. The memory elements can include local memory employed during actual implementation of the program code, bulk storage, and cache memories which provide temporary storage of at least some program code in order to reduce the number of times code must be retrieved from bulk storage during implementation.

Input/output or I/O devices (including but not limited to keyboards 408, displays 406, pointing devices, and the like) can be coupled to the system either directly (such as via bus 410) or through intervening I/O controllers (omitted for clarity).

Network adapters such as network interface 414 may also be coupled to the system to enable the data processing system to become coupled to other data processing systems or remote printers or storage devices through intervening private or public networks. Modems, cable modem and Ethernet cards are just a few of the currently available types of network adapters.

As used herein, including the claims, a "server" includes a physical data processing system (for example, system 412 as shown in FIG. 4) running a server program. It will be understood that such a physical server may or may not include a display and keyboard.

As noted, aspects of the present invention may take the form of a computer program product embodied in one or more computer readable medium(s) having computer readable program code embodied thereon. Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Media block 418 is a non-limiting example. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, radio frequency (RF), etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, component, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It should be noted that any of the methods described herein can include an additional step of providing a system comprising distinct software modules embodied on a computer readable storage medium; the modules can include, for example, any or all of the components shown in FIG. 1. The method steps can then be carried out using the distinct software modules and/or sub-modules of the system, as described above, executing on one or more hardware processors 402. Further, a computer program product can include a computer-readable storage medium with code adapted to be implemented to carry out one or more method steps described herein, including the provision of the system with the distinct software modules.

In any case, it should be understood that the components illustrated herein may be implemented in various forms of hardware, software, or combinations thereof; for example, application specific integrated circuit(s) (ASICS), functional circuitry, one or more appropriately programmed general purpose digital computers with associated memory, and the like. Given the teachings of the invention provided herein, one of ordinary skill in the related art will be able to contemplate other implementations of the components of the invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

At least one embodiment of the invention may provide one or more beneficial effects, such as, for example, computing scores (that is, reputations) of all messages both online and offline.

It will be appreciated and should be understood that the exemplary embodiments of the invention described above can be implemented in a number of different fashions. Given the teachings of the invention provided herein, one of ordinary skill in the related art will be able to contemplate other implementations of the invention. Indeed, although illustrative embodiments of the present invention have been described herein with reference to the accompanying drawings, it is to be understood that the invention is not limited to those precise embodiments, and that various other changes and modifications may be made by one skilled in the art.

What is claimed is:

1. A method for generating driving information based on one or more driver inputs, wherein the method comprises:

receiving information about one or more triggering factors from at least one of one or more internal entities and one or more external entities;

using the information to generate a message about the one or more triggering factors;

computing a credibility score by comparing the message with one or more of a decision computed by a voting algorithm and a set of one or more external events; and sending the message to one or more additional drivers, wherein one or more steps of said method are performed by one or more hardware devices.

2. The method of claim 1, further comprising dynamically updating credibility of each driver.

3. The method of claim 1, wherein sending the message to one or more additional drivers comprises sending a weighted message based on credibility of each driver that provided input.

4. The method of claim 1, wherein information from one or more external entities comprises at least one of information related to a global positioning system (GPS) and information related to a state of a vehicle.

5. The method of claim 1, wherein information from one or more internal entities comprises information about at least one of a driver from a driver graphical user interface and a car sensor.

6. The method of claim 1, wherein sending the message to one or more additional drivers comprises sending the message to one or more additional drivers via a driver graphical user interface of each driver.

7. The method of claim 1, wherein using the information to generate a message about the one or more triggering factors comprises computing a score for the message.

8. The method of claim 7, wherein computing a score for the message comprises computing a score for the message online, wherein computing the score for the message online comprises comparing the message with a decision computed by the voting algorithm.

9. The method of claim 7, wherein computing a score for the message comprises computing a score for the message off-line, wherein computing a score for the message off-line comprises:

enabling a driver to connect to a website that contains the set of one or more external events; and comparing the message with the one or more external events.

10. The method of claim 1, further comprising enabling the voting mechanism based on driver community information.

11. The method of claim 10, wherein the voting mechanism is used to make one or more determinations about one or more driving situations, and wherein the voting mechanism uses driver votes, state data and one or more weightings to make a determination about a driving situation.

12. The method of claim 1, wherein the method is run on a system, wherein the system comprises one or more distinct software modules, each of the one or more distinct software modules being embodied on a tangible computer-readable recordable storage medium, and wherein the one or more distinct software modules comprise a driver graphical user interface module, a global positioning system module, a peer-to-peer client module and a rule engine module executing on a hardware processor.

13. A computer program product comprising a tangible computer readable recordable storage medium including computer useable program code for generating driving information based on one or more driver inputs, the computer program product including:

computer useable program code for receiving information about one or more triggering factors from at least one of one or more internal entities and one or more external entities;

computer useable program code for using the information to generate a message about the one or more triggering factors;

computer useable program code for computing a credibility score by comparing the message with one or more of a decision computed by a voting algorithm and a set of one or more external events; and computer useable program code for sending the message to one or more additional drivers.

14. The computer program product of claim 13, wherein the computer useable program code for sending the message to one or more additional drivers comprises computer useable program code for sending a weighted message based on credibility of each driver that provided input.

15. The computer program product of claim 13, further comprising computer useable program code for dynamically updating credibility of each driver.

16. The computer program product of claim 13, wherein the computer useable program code comprises one or more distinct software modules, and wherein the one or more distinct software modules comprise a driver graphical user interface module, a global positioning system module, a peer-to-peer client module and a rule engine module executing on a hardware processor.

17. A system for generating driving information based on one or more driver inputs, comprising:

a memory; and at least one processor coupled to the memory and operative to:

receive information about one or more triggering factors from at least one of one or more internal entities and one or more external entities;

use the information to generate a message about the one or more triggering factors;

computing a credibility score by comparing the message with one or more of a decision computed by a voting algorithm and a set of one or more external events; and send the message to one or more additional drivers.

18. The system of claim 17, wherein the at least one processor coupled to the memory operative to send the message to one or more additional drivers is further operative to send a weighted message based on credibility of each driver that provided input.

19. The system of claim 17, wherein the at least one processor coupled to the memory is further operative to dynamically update credibility of each driver.

20. The system of claim 17, further comprising a tangible computer-readable recordable storage medium having one or more distinct software modules embodied thereon, the one or more distinct software modules comprising a driver graphical user interface module, a global positioning system module, a peer-to-peer client module and a rule engine module executing on a hardware processor.

* * * * *